US006403276B1

(12) United States Patent
Elst et al.

(10) Patent No.: US 6,403,276 B1
(45) Date of Patent: Jun. 11, 2002

(54) RADIOGRAPHIC UV/BLUE FILM MATERIAL AND INTENSIFYING SCREEN-FILM COMBINATION

(75) Inventors: Kathy Elst, Kessel; Paul Callant, Edegem; Ann Verbeeck, Begijnendijk, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/544,911

(22) Filed: Apr. 7, 2000

Related U.S. Application Data

(60) Provisional application No. 60/131,680, filed on Apr. 29, 1999.

(30) Foreign Application Priority Data

Apr. 16, 1999 (EP) ..... 99201189

(51) Int. Cl.[7] ..... G03C 5/16

(52) U.S. Cl. ..... 430/139; 430/567; 430/966; 430/570; 430/576; 430/577; 430/581; 430/599; 430/603; 430/604; 430/605

(58) Field of Search ..... 430/139, 567, 430/966, 576, 577, 570, 581, 599, 603, 604, 605

(56) References Cited

U.S. PATENT DOCUMENTS

| | | | | | |
|---|---|---|---|---|---|
| 4,334,001 | A | * | 6/1982 | Horie et al. | 430/581 |
| 5,989,799 | A | * | 11/1999 | Verbeeck et al. | 430/567 |
| 6,200,743 | B1 | * | 3/2001 | Elst et al. | 430/576 |

FOREIGN PATENT DOCUMENTS

| | | | |
|---|---|---|---|
| EP | 0 622 665 | A1 | 11/1994 |
| EP | 0 712 034 | A1 | 5/1996 |
| EP | 0 890 873 | A1 | 1/1999 |
| GB | 935385 | A | 8/1963 |

OTHER PUBLICATIONS

Patent Abstracts of Japan, Section Ch, Week 9515, Derwent Publications Ltd., London, GB, Class E23, AN 95–111445, XP002115113 and JP 07 036143 A, (Konica Corp.), Feb. 7, 1995.

* cited by examiner

*Primary Examiner*—Geraldine Letscher
(74) *Attorney, Agent, or Firm*—Breiner & Breiner, L.L.C.

(57) ABSTRACT

A film material has been provided with emulsions comprising {111} tabular silver halide grains rich in silver bromide, spectrally sensitive to irradiation in the wavelength range shorter than 420 nm by the presence of at least one blue spectral sensitizer and of at least one azacyanine dye, the formula of which has been given in the description and in the claims.

A radiographic screen/film combination or system has also been provided comprising a duplitized film sandwiched between a pair of supporting or self-supporting X-ray intensifying screens, characterized in that i) said pair of supported or self-supporting X-ray intensifying screens essentially consists of luminescent phosphor particles emitting at least 50% and more preferably at least 80% of their emitted radiation in the wavelength range shorter than 420 nm, ii) said film corresponds with the film material disclosed hereinbefore.

12 Claims, No Drawings

RADIOGRAPHIC UV/BLUE FILM MATERIAL AND INTENSIFYING SCREEN-FILM COMBINATION

This application claims priority from Provisional application Ser. No. 60/131,680, filed Apr. 29,1999.

FIELD OF THE INVENTION

This invention relates to a film material and a screen-film combination of a radiographic intensifying phosphor screen and said film material comprising blue-sensitized light-sensitive silver halide photographic emulsions having tabular grains rich in silver bromide.

BACKGROUND OF THE INVENTION

Combinations of intensifying screens provided with luminescent phosphors and light-sensitive silver halide photographic materials are conventionally used for medical diagnosis. By X-ray radiation the luminescent phosphors in the screen panel or panels are converting X-rays into visible radiation, thereby exposing the film material in contact with the said panel (for single-side coated materials as e.g. in mammography) or panels (for duplitized materials as e.g. in chest imaging).

It is clear that in order to get an image to be examined on the film that after said exposure the film material is processed in a wet processing cycle, requiring appropriate chemistry. A normal processing cycle, whether or not performed in an automatic processing machine, is following the steps of developing, fixing, rinsing an drying. The more film material is passing in the corresponding processing solutions of developer and fixer, the more both of them become exhausted. In order to overcome that problem replenishing is required.

As nowadays ecology becomes more and more important it is recommended to reduce amounts of processing chemicals (developer, fixer and corresponding replenishers) to a considerable extent in order to reduce waste chemicals. Within the same context it is recommended to reduce wash out or rinsing out of chemical compounds coated in the film material as e.g. wash out in the processing of sensitizing dyes or filter dyes present in hydrophilic layers of the said film material thereby causing deposition of dirt on the walls and rollers of the processing tanks.

Especially when the light-sensitive silver halide emulsion crystals have been made sensitive to visible light as e.g. to blue or green light emitted from blue light or green light emitting intensifying phosphor screens the corresponding spectral sensitizers and optionally present filter or antihalation dyes make arise the problem of insufficient removal from the film material, thereby causing residual color making increase minimum density and deviate image tone from the desired outlook of the processed image.

Silver bromide emulsion crystals have an absorption spectrum which is shifted towards longer wavelengths of the radiation spectrum if compared with silver chloride emulsion crystals the spectrum of which is shifted more to the ultraviolet range. Luminescent phosphors however are not completely matching the absorption spectra of non-spectrally sensitized emulsion crystals. Especially for the commercially available phosphors as e.g. $CaWO_4$ (see e.g. U.S. Pat. No. 3,300,311) emitting at 410 nm and BaFBr and $YTaO_4$.Nb (apart as in e.g. in U.S. Pat. No. 4,225,653 and EP-A 0 202 875 or in a mixture with BaFBr as in EP-A's 0 435 241 and 0 520 094) both emitting radiation at 390 nm the said radiation is not completely absorbed by light-sensitive non-spectrally sensitized emulsion crystals. Therefore many attempts have been performed in order to improve the sensitization in the blue and ultra-violet regions of the electromagnetic spectrum as has e.g. been disclosed in U.S. Pat. No. 5,108,887 wherein zeromethine merocyanine dyes as J-aggregating dyes for tabular grain emulsions have been disclosed; in EP-A 0 487 010, wherein supersensitization with a zeromethine dye and a tetra-azaindene has been proposed; in WO 93/11458 wherein arylidene sensitizing dyes have been added to the tabular silver bromide grain emulsions and in EP-A 0 712 034 wherein a method has been given in order to prepare blue-sensitized tabular grains having zeromethine-merocyanine dyes as spectrally sensitizing dyes. Novel zeromethine-merocyanine dyes have been disclosed in EP-A 0 794 232. The references cited are scarce examples wherein spectral sensitization of tabular grains rich in silver bromide in the blue and/or ultra-violet range of the spectrum is disclosed, opposite to the more frequently published papers with respect to green and red sensitization of said tabular grains, although combinations of blue/UV screen/film combinations are known to lead to a lower cross-over due to less radiation scatter in that wavelength range.

In order to provide, after processing of the (preferably forehardened) photographic material, an image having a suitable gradation and especially high covering power and low cross-over (leading to a high sharpness) it is indeed recommended as e.g. in U.S. Pat. Nos. 4,414,304; 4,425,425 and 4,425,426 to make use of emulsion crystals or grains having a tabular habit and a high aspect ratio: tabular grain emulsions having a high aspect ratio are known to provide several advantages over more conventional spherical grains as e.g. a high covering power, a high sensitivity and a lower coating weight, which saves costs in manufacturing. Said lower coating weight is especially preferred if rapid processing applications are required, which is nowadays an ever more returning demand.

Attaining the required sensitometry, particularly speed, even in a rapid processing cycle of less than 90 seconds making use of minimum amounts of replenisher solutions of developer and fixer, and further getting an image having the desired contrast, high definition, covering power and image tone (the improvement of which has e.g. been demonstrated in EP-A 0 770 909, wherein use has been made of a specific multi-layer arrangement with grains having a cubic crystal habit located farther from the support without showing disturbing residual coloration) remains an ever lasting demand.

OBJECTS OF THE INVENTION

Therefore it is an object of the present invention to provide a film material and a screen-film image-forming combination or system wherein a light-sensitive silver halide photographic material is combined with an intensifying screen in order to obtain an image suitable for medical diagnosis, having a very high image quality, i.e., low fog level, high overall-contrast with an enhanced sharpness (low cross-over) after rapid processing of the said material, wherein more particularly little or no residual color or dye stain is observed in the processed material even when minimum amounts of developer, fixer and their corresponding replenishers are used in the said processing.

SUMMARY OF THE INVENTION

In order to reach the objects of the present invention a light-sensitive silver halide photographic material has been provided comprising {111} tabular silver halide grains rich in silver bromide, spectrally sensitive to irradiation in the wavelength range shorter than 420 nm by the presence of at least one blue spectral sensitizer according to the formula (I) and of at least one azacyanine dye according to the formulae given hereinafter in the description and in the claims.

Moreover a radiographic screen/film combination or system has been provided comprising a duplitized film material, sandwiched between a pair of supported or self-supporting X-ray intensifying screens, characterized in that i) said pair of supported or self-supporting X-ray intensifying screens essentially consists of luminescent phosphor particles emitting at least 50% and more preferably at least 80% of their emitted radiation in the wavelength range shorter than 420 nm, as e.g. a niobium and gadolinium doped, monoclinic M, yttriumtantalate (MYT) phosphor or a calcium tungstate phosphor;

ii) said film comprises {111} tabular silver halide grains rich in silver bromide, spectrally sensitive to irradiation in the said wavelength range shorter than 420 nm by the presence of at least one blue spectral sensitizer according to the formula (I) and of at least one azacyanine dye according to the formulae as given hereinafter in the description and in the claims, wherein said emulsion is present in at least one light-sensitive emulsion layer at both sides of the film support.

DETAILED DESCRIPTION OF THE INVENTION

In order to prevent loss of speed and in order to prevent residual color or dye stain after processing it is advised not to use antihalation dyes as those described e.g. in U.S. Pat. No. 5,298,378 which are favorable in order to reduce internal scatter and print-through as disclosed therein, although dye stain may also be present after processing due to the presence, in high amounts of spectral sensitizing dyes, on the large main (111) faces of tabular grain emulsions having a large surface to volume ratio material. As can be examined from the diagnostic images obtained after processing of a film material according to the present invention it has now unexpectedly been observed that the objects of the present invention are effectively attained when besides spectral sensitizing dyes for the spectral sensitization in the near-ultraviolet to blue range of the wavelength spectrum of {111} tabular grains rich in silver bromide azacyanine dyes are present in the light-sensitive emulsion layer(s) of the said silver halide photographic material for use in a screen/film system of the present invention, said emulsion layer(s) being present in at least one light-sensitive emulsion layer at both sides of a film support.

In the film material according to the present invention said film thus comprises {111} tabular silver halide grains rich in silver bromide, spectrally sensitive to irradiation in the said wavelength range shorter than 420 nm by the presence of at least one dye according to the formula (I) and at least one azacyanine dye wherein in formula (I), representative for said (blue/near ultraviolet-sensitizing) dye given hereinafter

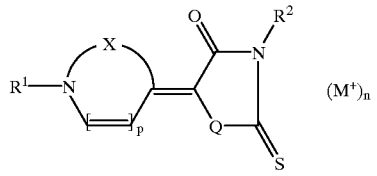

wherein:

X represent the atoms, necessary to form a heterocyclic 5- or 6-membered ring, whether or not conjugated with a benzene ring (as is typical for cyanine dyes);

Q represents S, $NR^3$, O, or —(C=O)—$N(R^4)$—;

$M^+$represents a kation, e.g., $Li^-$, $Na^+$, $K^+$, $HN^+(C_2H_5)_3$;

n equals 0, 1, or 2;

p equals 0 or 1;

$R^1$, $R^2$, $R^3$ and $R^4$ each independently represent a substituted or unsubstituted $C_1$–$C_5$ alkyl chain, or a substituted or unsubstituted (five- or six-membered) aromatic ring (as e.g. an aryl group giving rise to aryl sulfonamide derivatives), provided that at least one of $R^2$, $R^3$ and $R^4$ has a solubilizing group as, e.g., $(CH_2)_mSO_3^-$ or $(CH_2)_mN(R^{1-4})SO_3^-$ wherein m equals 1, 2, 3 or 4, wherein $R^{1-4}$ has the same meaning as $R^1$ to $R^4$;

$(CH_2)_2CH(Y)SO_3^-$ wherein Y represents $CH_3$—, —Cl or —OH;

$(CH_2)_qOSO_3^-$ wherein q equals 2 or 3;

$(CH_2)_rCO_2^-$ $(H^+)$ wherein r equals 1, 2 or 3;

$(CH_2)_sSO_2^-$ $(CH_2)_tH$ wherein s equals 2 or 3 and t equals 1 or 2;

$(CH_2)_x$-Phen-W, wherein W represents —$COO^-$ or $SO_3^-$; Phen represents phenyl which is substituted or unsubstituted; and x equals 1, 2, 3 or 4;

or a latent solubilizing group as, e.g., $(CH_2)_{m'}$—(C=O)—O—$CH_2$—(C=O)—$CH_3$, wherein m' is an integer having a value of from 1 to 5.

More particularly in the film material according to the present invention {111} tabular emulsion crystals rich in silver bromide have been blue-sensitized with one or more dyes corresponding to the formula (I.1) or (I.2)

(I.1)

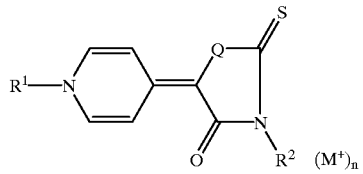

(I.2)

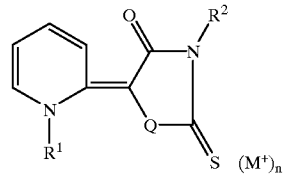

An especially preferred blue-sensitizing dye for spectrally sensitizing {111} tabular silver bromide grains is given hereinafter (see formula I.1.1)

(I.1.1)

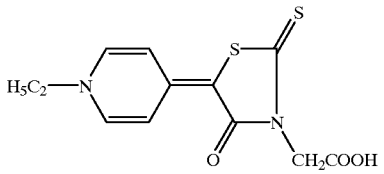

5-(1-Ethyl-4(1H)-Pyridylene)-4-Oxo-2-thioxo-3-thiazolidine Acetic Acid

Another dye is represented by its structure (I.3), wherein X is conjugated with a benzene ring in order to get e.g. a benzothiazole nucleus. Other combinations as e.g. with a benzoxazine, with a benzoselenazole or with a benzimidazole nucleus are also possible.

(I.3)

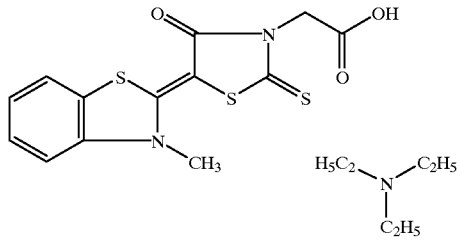

5-(3-Methyl-3(3H)-Benzothiazolylidene)-4-Oxo-2-thioxo-3-thiazolidine Acetic Acid As will become clear from the Examples given hereinafter the said blue-sensitizing dye or dyes are present besides at least one azacyanine dye (the formulae of which have been given under formulae II) in order to reach the objects of the present invention, thereby reducing dye stain after processing and improving speed.

Said blue-sensitizing dye or dyes are added as first dye during the chemical ripening procedure, before addition of the chemical ripening compounds or agents as will further be illustrated in the Examples given hereinafter. Mixtures of blue sensitizing dyes according to formula (I) wherein Q is S for one dye and O for the other are particularly interesting from the point of view of an increased spectral response in form of speed, which can be achieved at lower total amounts of dyes as has been made clear in U.S. Pat. No. 5,707,794.

With respect to dyes according to the formula (II) the synthesis of aza- or diazacyanine dyes, used in light-sensitive emulsion layers of materials according to the present invention besides blue/near-ultraviolet spectrally sensitizing dyes, and use of said azacyanine dyes in silver halide emulsions has been described in U.S. Pat. No. 2,307,049. Azamethine spectral sensitizers made with arylene diamine can further be found in U.S. Pat. No. 2,368,305. Sensitization of photographic emulsions with dyes comprising azacyanine dyes has been disclosed in U.S. Pat. No. 2,080,050. In 1961 aza-pseudocyanines, for use as optical brighteners have been disclosed in U.S. Pat. No. 3,130,197, whereas in 1968, acid substituted azaquino-pseudo-cyanines or cyazines were disclosed in U.S. Pat. No. 3,697,282 for use as spectral sensitizers in color materials. Symmetrical and unsymmetrical quinoline azacyanine dyes can further be found in BE 812431 and in CS 1976695 respectively. Pseudo-cyanine or azamethine dyes have more recently been disclosed in U.S. Pat. No. 4,977,076. It is however remarkable that, as has been set forth by Tani in Kogyo Kagaku Zasshi 71(4), 604–605(1968), *azacyanines do not work as spectral sensitizers on grains rich in silver bromide*. However as has been shown in the present invention presence of one or more azacyanine(s) beside a blue spectral sensitizer of {111} tabular grains rich in silver bromide is in favor of speed (sensitivity) and in favor of a decrease of dye stain as the presence of said azacyanine dye(s) makes a reduction of amounts of blue-sensitizing dye on the surface of said tabular grains possible. Specific azacyanine dyes suitable for use in the material of the film-screen system according to the present invention are following:

(II.1)

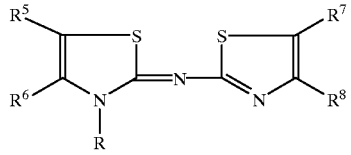

(II.2)

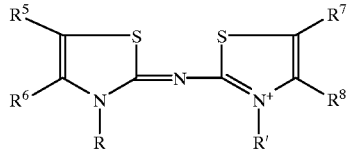

wherein each of the substituents $R^5$–$R^8$ independently represents hydrogen, an (unsubstituted or substituted) alkyl, an (unsubstituted or substituted) aryl or an (unsubstituted or substituted) aralkyl;

wherein $R^5$ and $R^6$ and/or $R^7$ and $R^8$ may form a (substituted or unsubstituted) benzoring, which, if substituted, has the same or different substituents as $R^5$–$R^8$;

wherein R represents an (substituted or unsubstituted) alkyl, aryl or aralkyl group;

wherein R' represents hydrogen, an (substituted or unsubstituted) alkyl, aryl or aralkyl group;

and wherein cations and/or anions are present as charge compensating ions.

More particularly each of R and R' independently represents $(CH_2)_{n'}H$ or $(CH_2)_{n'}OH$, n' being an integer having a value from 1 to 4, $(CH_2)_{m'}(SO_3^-)$ or $(CH_2)_{m'}O(SO_3^-)$, m' being an integer having a value from 2 to 4, $(CH_2)_2CH(Y')SO_3^-$ wherein Y' represents $CH_3$—, —Cl or —OH;

$(CH_2)_{m'}N(R)SO_3$ or $(CH_2)_{m'}N(R')SO_3^-$ $(CH_2)_{n'}(COO^-)$ or $(CH_2)_{n'}(COOH)$, $(CH_2)_{s'}SO_2^-(CH_2)_{t'}H$ wherein s' equals 2 or 3 and t' equals 1 or 2;

$(CH_2)_{x'}$-Phen-W', wherein W' represents —$COO^-$ or $SO_3^-$; Phen represents phenyl which is substituted or unsubstituted; and x' equals 1, 2, 3 or 4, $(CH_2)_{n'}CONHSO_2R$ or $(CH_2)_{n'}CONHSO_2R'$, provided that R' may represent hydrogen as set forth hereinbefore or a latent solubilizing group as, e.g., $(CH_2)_{m'}$—(C=O)—O—$CH_2$—(C=O)—$CH_3$, wherein m' is an integer having a value of from 1 to 5.

In order to get neutral azacyanine structures preferred charge compensating cations are $Li^+$, $Na^+$, $K^+$, $HN^+Et_3$, wherein Et represents ethyl, whereas preferred charge compensating anions are $Cl^-$, $Br^-$, $I^-$, $^-OTos$, $^-OMes$, $CF_3SO_3^-$, wherein $^-OTos$ represents tosylate and $^-OMes$ represents mesylate.

Specific examples of azacyanine dyes are given in the formulae (II.3) to (II.13) hereinafter:

(II.3)

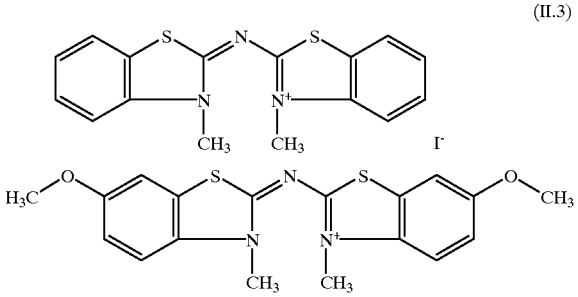

(II.4)

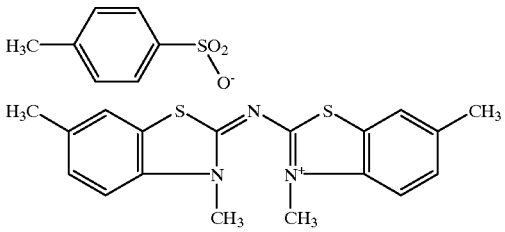

(II.5)

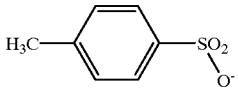

(II.6)

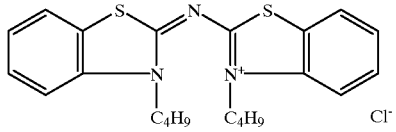

(II.7)

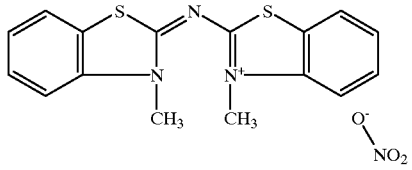

(II.8)

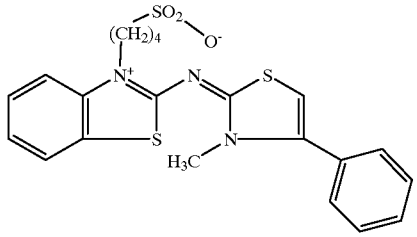

(II.9)

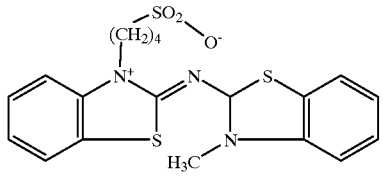

-continued (II.10)

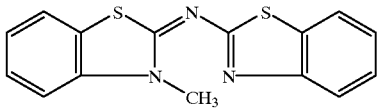

(II.11)

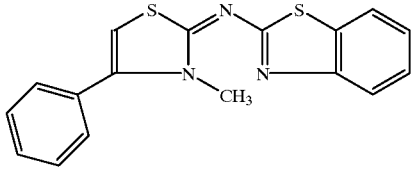

(II.12)

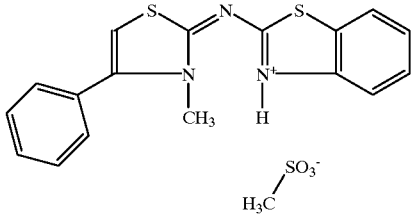

(II.13)

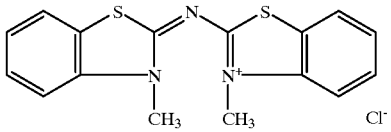

Besides said (non-J-aggregating) azacyanine dye or dyes non-J-aggregating monomethine cyanine dyes may be present, e.g., as those represented by the general formula (III)

(III)

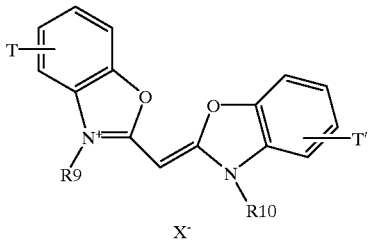

wherein each of $R^9$ and $R^{10}$ independently represents a substituted or unsubstituted $C_1$–$C_5$ alkyl chain, or a substituted or unsubstituted (five- or six-membered) aromatic ring, provided that at least one of $R^9$ and $R^{10}$ has a solubilizing group or a latent solubilizing group;

wherein T and T' each independently represents a substituted or unsubstituted alkyl, a substituted or unsubstituted aryl or a substituted or unsubstituted heterocyclic group and wherein X is an anion, providing electrical neutrality. In another embodiment each of R9 and R10 may independently represent $(CH_2)_{n''}H$ or $(CH_2)_{n''}OH$, n" being an integer having a value from 1 to 4, $(CH_2)_{m''}(SO_3^-)$ or $(CH_2)_{m''}O(SO_3^-)$, m" being an integer having a value from 2 to 4, $(CH_2)_2CH(Y'')SO_3^-$ wherein Y" represents $CH_3$—, —Cl or —OH;

$(CH_2)_{m''}N(R)SO_3^-$ or $(CH_2)_{m''}N(R')SO_3^-$ $(CH_2)_{n''}(COO^-)$ or $(CH_2)_{n''}(COOH)$, $(CH_2)_{n''}CONHSO_2R$ or $(CH_2)_{n''}CONHSO_2R'$, wherein R and R' have the same meaning as explained hereinbefore and wherein X is an anion, providing electrical neutrality of the molecule;

$(CH_2)_{n''}(COO^-)$ or $(CH_2)_{n''}(COOH)$, $(CH_2)_{s''}SO_2^-(CH_2)_{t''}H$ wherein s" equals 2 or 3 and t" equals 1 or 2;

$(CH_2)_{x''}$-Phen-W", wherein W" represents $—COO^-$ or $SO_3^-$; Phen represents phenyl which is substituted or unsubstituted; and x" equals 1, 2, 3 or 4;

a latent solubilizing group as, e.g., $(CH_2)_{m'''}—(C=O)—O—CH_2—(C=O)—CH_3$, wherein m"' is an integer having a value of from 1 to 5 or $(CH_2)_{n''}CONHSO_2R$ or $(CH_2)_{n''}CONHSO_2R'$, provided that R' may represent hydrogen as set forth hereinbefore. When T and/or T' represent(s) a substituted or unsubstituted heterocyclic group, said heterocyclic group may be a saturated or unsaturated five membered or six membered ring, whether or not conjugated with a benzene ring. More particular general structures according to the general formula (III), without being exhaustive therefor, are given hereinafter in the formulae (III.G1)–(III.G6).

(III.G1)

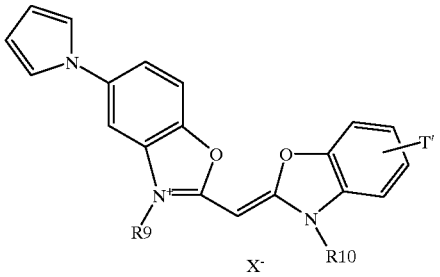

(III.G2)

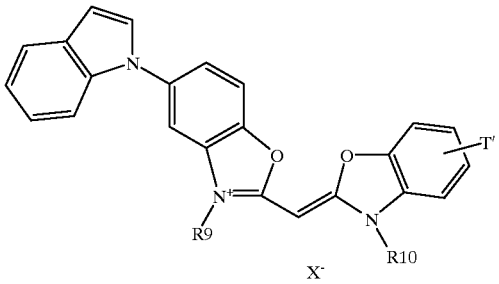

(III.G3)

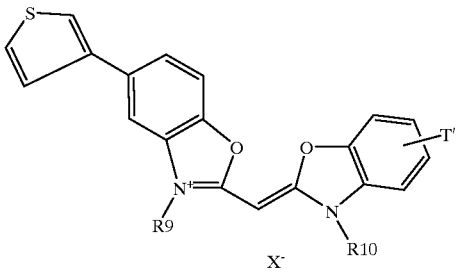

-continued (III.G4)

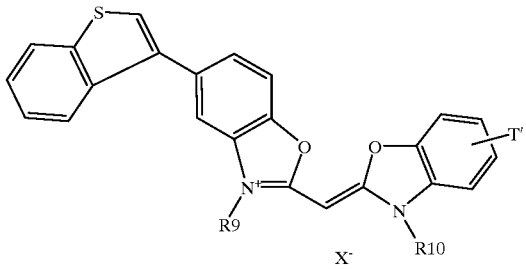

(III.G5)

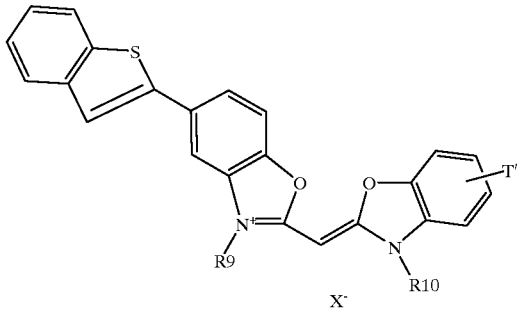

(III.G6)

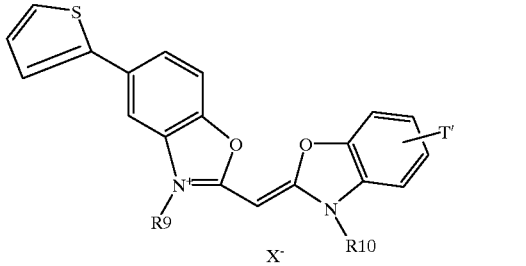

Particularly preferred monomethine cyanine dyes which may be used as monomethine cyanine dyes in emulsions coated in light-sensitive layers of the material used in the film/screen system of the present invention correspond to the formula (III.1) or (III.2), represented hereinafter:

(III.1)

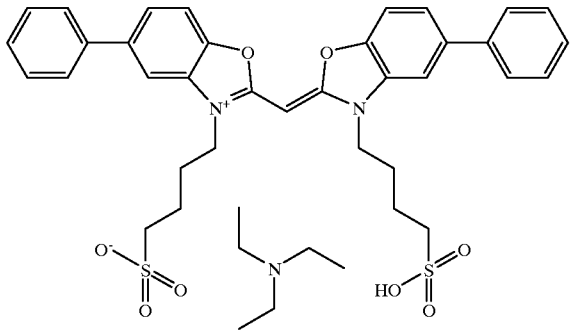

-continued (III.2)

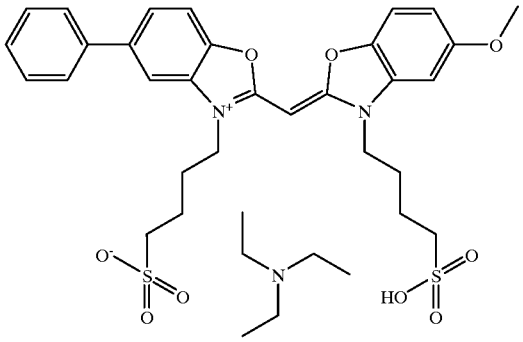

The film material according to the present invention comprises light-sensitive layers at both sides of the film support wherein {111} tabular silver halide grains rich in silver bromide are present, said grains having an average aspect ratio of 5 or more, an average grain thickness of at most 0.25 μm, and account for at least 50% of the total projective area of all grains. More preferably said grains have an average aspect ratio of from 5 up to 20, an average grain thickness of from 0.06 μm to 0.22 μm, and account for at least 70% of the total projective area of all grains. In a further preferred embodiment the tabular grain population making part of a light-sensitive emulsion is homogeneous, i.e., has a variation coeffient of less and 0.40 and more preferably even from 0.10 up to 0.30.

Preparation methods for {111} tabular grain emulsions rich in silver bromide can be found in Research Dislosure No. 389057, p. 591–639 (1996), more particularly in Chapter I. A very useful method has been described in EP-A 0 843 208.

Said {111} tabular crystals rich in silver bromide are composed of silver bromide, silver bromochloride, silver bromochloroiodide or silver bromoiodide. When iodide is present it is preferred, in the context of rapid processing (developing and fixing) ability, to have at most 3 mole % of iodide present, more preferably at most 1 mole % and even still more preferably from 0.05 up to 0.5 mole %. Iodide ions can be divided homogeneously over the tabular grain volume, but it can be preferred to build up a core-shell structure wherein the shell is containing more or less iodide than the core or wherein both distinct phases are separated by a silver halide band rich in silver iodide, or even consisting of pure silver iodide, realized e.g. by conversion wherein iodide ions are replacing halides of much more soluble silver halide salts as silver chloride and/or silver bromide. Addition of iodide is normally performed by addition of an inorganic iodide salt as potassium iodide. If slower liberation of iodide in the reaction is desired addition of organic iodide releasing agents leads to an increased iodide concentration. Addition of iodide by organic agents releasing iodide ions, which is an embodiment which can advantageously be applied within the context of the preparation of emulsions for use in materials according to the present invention, is in favour of the realization of homogeneous distribution of iodide into the crystal volume of {111} tabular grains or crystals containing silver iodide as has been demonstrated e.g. in EP-A's 0 561 415, 0 563 701, 0 563 708 and 0 651 284 and in U.S. Pat. Nos. 5,482,826 and 5,736,312. In an alternative method iodide ions can be released from iodate as has been described in U.S. Pat. No. 5,736,312. Release of iodide in the presence of a compound adjusting the rate of iodide release can be applied as described in U.S. Pat. No. 5,807,663 in order to get a multilayered structure in the silver halide tabular emulsion grains.

Addition of iodide to emulsion grains rich in silver bromide is however also possible by adding fine preformed grains of silver iodide, whether or not including bromide and/or chloride in minor amounts, said grains having a grain diameter of not more than 100 nm, and, more preferably, not more than 50 nm. Such fine grains are so-called "Lippmann" emulsions. Addition of iodide making use from such fine silver iodide grains has been described for the preparation of {111} tabular grains in JP-A's 04251241 and 08029904 and in EP-A's 0 662 632 and 0 658 805, wherein an outermost phase rich in silver iodide has been added to {111} tabular grains rich in silver bromide. More particularly ultrafine AgI-grains can be introduced as seed emulsions as has been described in EP-A 0 621 505 or can be used in order to prepare core-shell emulsions as described in EP-A 0 517 434, wherein two phases in the crystal differing in composition have thus been built up. In order to improve speed supplying of said ultrafine grains may proceed in the presence of an oxidizin g agent as has been described in EP-A 0 576 920. Addition of said fine AgI-Lippmann emulsions to the surface of the silver halide crystals in order to get a global iodide content of less than 1 mole % in the grain may advantageously proceed as disclosed in EP-A 0 475 191, wherein an excellent speed/fog ratio and a high covering power are attained.

It is clear that {111} tabular silver halide emulsion grains, present in light-sensitive emulsion layers of materials according to the present invention, are, besides spectrally sensitized in the blue to near ultraviolet wavelength range, also chemically sensitized, preferably with compounds providing sulphur, selenium and gold. Chemical sensitization methods for {111} tabular grain emulsions rich in silver bromide can be found in Research Dislosure No. 389057, p. 591–639 (1996), more particularly in Chapter IV. Very useful methods related therewith have been disclosed in EP-A's 0 443 453, 0 454 069, 0 541 104 and in U.S. Pat. Nos. 5,112,733 and 5,654,134 wherein use of labile tellurium compounds has also been claimed. Useful labile selenium compounds have been disclosed in EP-A's 0 831 363, 0 889 354 and 0 895 121.

Preparation of spectrally and chemically sensitized tabular grains as applied to emulsion grains to be coated in one or more ligh t-sensitive layer of a material according to the present invention has been described in U.S. Pat. No. 4,439,520, wherein it has been established to perform spectral sensitization before chemical sensitization, so that the spectral sensitizer acts as a site-director for the sensitivity specks, generated during chemical sensitization. A broad review about spectral sensitization can be found in in Research Dislosure No. 389057, p. 591–639 (1996), more particularly in Chapter V. Further useful information about additives which may be used in order to prepare emulsions to be coated in a material according to the present invention can be found in Research Dislosure No. 389057, p. 591–639 (1996), as in Chapter VII about antifoggants and stabilizers, in Chapter VIII about coating physical property modifying addenda, in Chapter XI about layer arrangements and in Chapter XV about supports.

As it is a favorable aspect for materials coated from emulsions having tabular grains to be coated with lower amounts of silver without loss of covering power in the material according to the present invention the total amount of coated silver halide in said film, expressed as an equivalent amount of silver nitrate, is less than 7.5 g/m$^2$.

In practical applications the film material according to the present invention preferably is a duplitized material, i.a., a light-sensitive photographic material comprising in its light-sensitive emulsion layers coated on both sides of a subbed support an emulsion having {111} tabular grains rich in silver bromide, spectrally sensitive to irradiation in the wavelength range shorter than 420 nm by the presence of at least one blue spectral sensitizer according to the formula (I) and of at least one azacyanine dye corresponding to the formulae (II.1) and (II.2) as described hereinbefore. It is however clear that use of a duplitized material as in the present invention does however not exlude use in a single-side coated material, whether or not in radiographic applications, as such a black-and-white silver halide material can also be used e.g. in micrography, in aviation photography, in black-and-white cinefilms, in laserfilms or hardcopy films and in graphic or reprographic applications.

Said duplitized film materials for use in radiographic applications are irradiated by the light emitted imagewise by X-ray intensifying screens in intimate contact therewith at both sides of the coated film support during X-ray exposure of part of a patient. A diagnostic silver image thereof, in conformity with the X-ray image, is obtained after processing of the said film material. For use in common medical radiography (projection radiography) the X-ray film material comprises a transparent film support, coated on both sides with at least one silver halide emulsion layer, further overcoated with at least one protective antistress layer and, optionnally, an afterlayer as disclosed e.g. in EP-A's 0 644 454 and 0 644 456. During the X-ray irradiation said film is arranged in a cassette between two X-ray intensifying screens each of them making contact with its corresponding light-sensitive side, thus forming a film/screen system.

According to the present invention a radiographic screen/film combination or system has been provided comprising a duplitized film material, sandwiched between a pair of supported or self-supporting X-ray intensifying screens, characterized in that i) said pair of supported or self-supporting X-ray intensifying screens essentially consists of luminescent phosphor particles emitting at least 50% and more preferably at least 80% of their emitted radiation in the wavelength range shorter than 420 nm, as e.g. a niobium and gadolinium doped, monoclinic M, yttriumtantalate (MYT) phosphor or a calcium tungstate phosphor;

ii) said film comprises {111} tabular silver halide grains rich in silver bromide, spectrally sensitive to irradiation in the said wavelength range shorter than 420 nm by the presence of at least one blue spectral sensitizer according to the formula (I) and of at least one azacyanine dye according to the formulae given in the description and in the claims, wherein said emulsion is present in at least one light-sensitive emulsion layer at both sides of the film support.

As the film material as claimed has as least one emulsion comprising {111} tabular silver halide grains rich in silver bromide, spectrally sensitive to irradiation in the wavelength range shorter than 420 nm by the presence of at least one spectrally sensitizing dye according to the formula (I) and of at least one azacyanine dye, the film perfectly matches with the screen emitting said radiation in the wavelength range shorter than 420 nm as in a preferred embodiment of the present invention absorption of radiation in the said wavelength range shorter than 420 nm by the {111} tabular silver halide grains rich in silver bromide is corresponding with at least 50% and more preferably at least 80% of the total radiation absorption by the said grains. This does however not exclude the presence in the film material (in minor amounts) of spectrally sensitizing dyes absorbing light in the wavelength range exceeding 420 nm and even, depending on specific needs, in the wavelength range exceeding e.g. 500 nm.

Luminescent phosphors suitable for use in a conventional intensifying screen of a radiographic film/screen system as the one according to the present invention must have a high prompt emission of fluorescent light on X-ray irradiation and low afterglow in favour of image sharpness. The relationship between resolution and speed of X-ray intensifying screens is described e.g. in Med. Phys. 5(3), 205 (1978). Specific intensifying screens emitting ultraviolet-blue radiation have e.g. been disclosed in U.S. Pat. Nos. 4,225,653; 4,387,141; 4,710,637; 5,112,700; 5,173,611 and 5,432,351; in EP-A's 0 650 089; 0 658 613; in PCT-Applications WO 93/11457 and WO 95/15514. Typical blue-UV emitting phosphors therein are tantalates as described in PCT-Applications WO 93/1521 and 93/1522, hafnates as described in U.S. Pat. No. 5,173,611 and fluorohalides (fluorobromides) of barium and strontium as in WO 91/1357 and U.S. Pat. No. 5,629,125, doped with europium and co-doped with samarium as in U.S. Pat. Nos. 5,422,220 and 5,547,807 and even mixtures of tantalates and fluorohalides as in U.S. Pat. No. 5,077,145 and EP-A 0 533 234, replacing $CaWO_4$ as representative for an older well-known generation of luminescent phosphors. Very useful phosphor particles have e.g. been disclosed in EP-A 0 820 069 wherein particles of niobium doped, monoclinic M, yttriumtantalate phosphor and particles of an europium doped bariumfluorohalide phosphor are composing the screen.

In the film/screen system according to the present invention preferred phosphor particles are niobium and gadolinium doped, monoclinic M, yttriumtantalate (MYT) phosphor corresponding to formula (IV):

$$YTaO_4{:}Gd{:}Nb \qquad (IV)$$

X-ray intensifying screens according the present invention can be self-supporting or supported. X-ray intensifying screens in accordance with the present invention generally comprise in order: a support (also called substrate), at least one layer comprising phosphor particles dispersed in a suitable binder and a protective coating coated over the phosphor containing layer to protect said layer during use. Further, a primer layer is sometimes provided between the phosphor containing layer and the substrate to closely bond said layer thereto. Examples of support materials include cardboard, plastic films such as films of cellulose acetate, polyvinyl chloride, polyvinyl acetate, polyacrylonitrile, polystyrene, polyester, polyethylene terephthalate, polyamide, polyimide, cellulose triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. A plastic film is preferably employed as the support material. Depending on the speed class of the screens for which a synergistic effect should be attained in the relation between speed and sharpness, supports characterized by their reflectance properties, expressed as % reflectance over the wavelength range from 350 to 600 nm, are particularly used. Such supports can be highly light reflecting as e.g. polyethylene terephthalate comprising a white pigment, e.g. $BaSO_4$, $TiO_2$, etc., or it can be light absorbing supports, e.g. polyethylene terephthalate comprising a black pigment, e.g. carbon black. Supports comprising dyes or pigments that absorb light of a specific wavelength can also be useful in the preparation of X-ray intensifying screens in the film/screen system according to the present invention.

In most applications the phosphor layers contain sufficient binder to give structural coherence to the layer. In view of a possible phosphor recovery from worn-out screens the binder of the phosphor containing layer is preferably soluble and remains soluble after coating. Useful binders, a non-limitative survey of which is given herein, include proteinaceous binders, e.g. gelatin, polysaccharides such as dextran, gum arabic, and synthetic polymers such as polyvinyl butyral, polyvinyl acetate, nitrocellulose, ethylcellulose, vinylidene chloride-vinyl chloride copolymer, polyalkyl (meth)acrylate, vinyl chloride-vinyl acetate copolymer, polyurethane, cellulose acetate, cellulose acetate butyrate, polyvinyl alcohol, polystyrene, polyester, etc. These and other useful binders are disclosed e.g. in U.S. Pat. Nos. 2,502,529; 2,887,379; 3,617,285; 3,300,310; 3,300,311 and 3,743,833. A mixture of two or more of these binders may be used, e.g., a mixture of polyethyl acrylate and cellulose acetobutyrate. The weight ratio of phosphor to binder is generally within the range of from 50:50 to 89:11, preferably from 80:20 to 89:11.

The screen according to the present invention may comprise a supported layer of phosphor particles dispersed in a binding medium comprising one or more rubbery and/or elastomeric polymers as described in EP-A's 0 647 258 and 0 648 254. In this way a ratio by weight of pigment to binding medium of more than 90:10 and more preferably of at least 93:7, e.g. 98:2 can be obtained providing besides an excellent image resolution a high ease of manipulation as a result of a good elasticity of the screen and good adhesion properties between the support and the phosphor layer. Problems concerning staining of screens comprising said rubbery binder(s) may be overcome by the addition of known rubber anti-oxidation compounds like IRGANOX 1010 and IRGASTAB T36 (trademarked products of CIBA-GEIGY, Basel, Switzerland), ANTIOXIDANT 330 (trademarked product of ETHYL CORP., Richmond, USA), VANOX 2246 (trademarked product of VANDERBILT ENERGY CORP., Denver, Canada) etc, this list being non-limitative. The binder used in screens according to the present invention, with high phosphor to binder ratio, can beneficially be a polymer P having a $T_g$ £ 0° C., an average molecular weight ($MG_{avg}$) between 5000 and $10^7$, being soluble in ethylacetate for at least 5% by weight (% wt/wt). A self-supporting layer of 82% by volume of phosphor particles in said polymer P, having a thickness so has to comprise 100 mg of phosphor particles per $cm^2$, has an elongation to break of at least 1%. Such polymers have been disclosed in EP-A 0 758 012 and the corresponding U.S. Pat. No. 5,663,005.

The phosphor layer can be applied to the support by employing a method such as vapour deposition, sputtering and spraying but is usually applied by the following procedure. Phosphor particles and a binder are added to an appropriate solvent as described hereinafter, and are then mixed in order to prepare a coating dispersion comprising the phosphor particles homogeneously dispersed in the binder solution. Said coating dispersion may further comprise a dispersing agent and plasticizer and filler material as described hereinafter. The coating dispersion containing the phosphor particles and the binder is applied uniformly onto the surface of the support to form a layer of the coating dispersion. The coating procedure may proceed according to any conventional method such as doctor blade coating, dip-coating or roll coating. For the preparation of highly abrasion resistant and chemically resistant phosphor-binder layers the binder is cured. Curing of the binder may proceed photochemically by means of UV radiation or with electron beam (EB) as described e.g. in Research Disclosure December 1977, item 16435 or proceeds purely chemically as described e.g. in U.S. Pat. No. 4,508,636. It may also be cured by moisture as described in EP-A 0 541 146. Curing may also be performed by heating. In the preparation of the phosphor screen having a primer layer between the substrate and the fluorescent layer, the primer layer is provided on the substrate beforehand, and then the phosphor dispersion is applied to the primer layer and dried to form the fluorescent layer. After applying the coating dispersion onto the support, the coating dispersion is then heated slowly to dryness in order to complete the formation of a phosphor layer. In order to remove entrapped air in the phosphor coating composition as much as possible it can be subjected to an ultrasonic treatment before coating. The phosphor-binder layer (as described e.g. in U.S. Pat. No. 4,059,768) can be calendered to improve the phosphor packing density in the dried layer.

Useful solvents for the binder of the phosphor containing layer, employable in the preparation of the phosphor coating dispersion include lower alcohols such as methanol, ethanol, n-propanol and n-butanol; chlorinated hydrocarbons such as methylene chloride and ethylene chloride; ketones such as acetone, butanone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether; methyl glycol; and mixtures of the above-mentioned solvents.

Useful dispersing agents for the phosphor particles in the coating dispersion to improve the dispersibility of the phosphor particles therein, may contain a variety of additives such as a plasticizer for increasing the bonding between the binder and the phosphor particles in the phosphor layer. Examples of the dispersing agent include ionic and nonionic well-known dispersing agents or combinations thereof, e.g., DISPERSE AYD (trade name of Daniel Products Company, New Jersey, USA) GAFAC RM 610 (a tradename a polyoxyethylene (20) sorbitan monopalmitate and monolaurate marketed by General Aniline and Film Company (GAF) New York, USA, polymeric surfactants such as the acrylic graft copolymer, PHOSPHOLIPON 90 (trade name) marketed by Nattermann-Phospholipid GmbH, Köln, W. Germany, silane dispersing agents and surfactants e.g. DOW CORNING 190 (trade name) and SILANE Z6040 (trade name) marketed by Dow Corning Corporation, Midland, Michigan, USA or glymo-3-glycidyloxypropylmethoxysilane or organosulfate polysilanes, unsaturated p-aminamide salts and high molecular acid esters such as ANTI TERRA U 80 (trade name) marketed by BYK-Chemie GmbH, Wesel, W. Germany, high molecular unsaturated polyesters, etc. Dispersing agents are added in an amount of 0.05 to 10% by weight based on the phosphor.

Useful plasticizers include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; polymeric plastizers, e.g. and polyesters of polyethylene glycols with aliphatic dicarboxylic acids such as polyester of triethylene glycol with adipic acid and polyester of diethylene glycol with succinic acid.

After the formation of the fluorescent layer, a protective layer is generally provided on top of the fluorescent layer. In a prefer-red embodiment the protective coating has a layer thickness d comprised between 1 and 50 $\mu$m and an embossed surface roughness is applied for high ease of manipulation, thereby avoiding sticking, friction and electrostatic attraction with maintenance of an excellent image resolution. The embossed protective layer can be provided on the phosphor layer in order to protect it against mechanical and chemical damage by the steps of (1) coating onto said phosphor containing layer a liquid radiation-curable composition having at the coating temperature a viscosity of at least 380 mPa.s, measured with a Hoeppler viscometer,that does not penetrate for a substantial degree into the phosphor containing layer, (2) providing an embossed structure to the coating, and (3) curing said coating by radiation.

More details concerning preferred protective coatings with embossed surface can be found in EP-A's 0 510 753 and 0 510 754.

Assemblies providing means for reducing cross-over to less than 10% for radiation longer than 300 nm in wavelength have been described e.g. in U.S. Pat. No. 5,259,016.

According to the present invention a method of image formation is obtained by consecutively performing the steps of exposing to X-rays the radiographic screen/film combination or system described hereinbefore; followed by processing the film according to the present invention by the steps of developing, fixing, rinsing and drying.

The said processsing is preferably performed in an automatic processsing machine. More in detail for processing the film material of the present invention, preferably an automatically operating apparatus is used provided with a system for automatic replenishment of the processing solutions. The processing dry-to-dry within a short processing time of from 30 to 90 seconds and more preferably from 30 seconds to less than 60 seconds of materials coated from low amounts of silver is made possible by the steps of developing said material in a developer (preferably) without hardening agent;

fixing said material in a fixer, optionally without hardening agent;

rinsing and drying said material.

A normally used configuration in the processing apparatus shows the following consecutive tank units corresponding with, as consecutive solutions: developer-fixer-rinse water.

Recent developments however have shown, that from the viewpoint of ecology and especially with respect to reduction of replenishing amounts, as consecutive solutions the sequence developer-fixer-fixer-rinse water-rinse water is preferred. One washing step between developing and fixation and one at the end before drying may also be present.

As ecology and low replenishing amounts are main topics with respect to the present invention use is made of concentrated hardener free processing solutions in one single package. Examples thereof have been disclosed e.g. in U.S. Pat. Nos. 5,187,050 and 5,296,342.

Especially preferred developers comprising ecologically acceptable developing agents such as ascorbic acid and derivatives thereof have been described in EP-A 0 732 619 and in U.S. Pat. Nos. 5,593,817 and 5,604,082. Instead of or partially substituting (e.g. in a ratio by weight of from 1:1 up to 9:1) the ecologically questionable "hydroquinone" (iso) ascorbic acid, 1-ascorbic acid and tetramethyl reductic acid are preferred as main developing agent in the developer. Said developing agents have further been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure No 371052, published Mar. 1, 1995, wherein a more general formula covering the formula of said developing agents has been represented.

In order to reduce "sludge formation" which is favored by solubilizing agents like sulphites, present in the developer as preservatives, a particularly suitable developer solution is the one comprising a reduced amount of sulphite and ascorbic acid which acts as a main developer and antioxidant as well and which is called "low-sludge" developer.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" have further been described in U.S. Pat. Nos. 5,447,817; 5,462,831 and 5,518,868. A particularly suitable fixer solution comprises an amount of less than 25 g of potassium sulphite per liter without the presence of acetic acid wherein said fixer has a pH value of at least 4.5, in order to make the fixer solution quasi odorless.

If however aluminum ions are present in the fixer composition for whatever a reason, the presence of α-ketocarboxylic acid compounds is recommended as has been described in EP-A's 0 620 483 and 0 726 491 as well as in RD 16768, published March 1978.

It is possible to use sodium thiosulphate as a fixing agent, thus avoiding the ecologically undesirable ammonium ions normally used. For low coating amounts of emulsion crystals rich in chloride a fixation time which is reduced to about 2 to 10 seconds can be attained. Moreover regeneration is kept to a minimum, especially in the processing of materials coated from very low amounts of emulsion crystals rich in silver chloride. Preferred minimum regeneration or replenishment amounts are from 20 to 200 ml/m$^2$ , more preferred from 20 to 100 ml/m$^2$, and still more preferred from 20 to 50 ml/m$^2$ of developed material. Materials coated from higher amounts of silver will require the higher amounts of replenisher but in most practical cases replenishment amounts of less than 200 ml/m$^2$ are attainable. Replenishment of a developer comprising ascorbic acid or derivatives thereof and a 3-pyrazolidone derivative has been described in EP-A 0 573 700, wherein a method is disclosed for processing with constant activity image-wise exposed silver halide photographic material comprising the steps of developing photographic material in a continuous automatic way by means of a developing solution containing an ascorbic acid analogue or derivative and a 3-pyrazolidone derivative as developing agents and replenishing said developing solution by means of at least one replenishing solution having a higher pH than the developing solution. In an alternative method the replenisher is added as a powder. Other references related therewith are EP-A 0 552 511; U.S. Pat. No. 5,503,965 and further in EP-A 0 660 175, wherein a method of replenishment control is described. For the fixer preferred minimum regeneration or replenishment amounts are also from about 20 to 200 ml/M$^2$, more preferred from 20 to 100 ml/m$^2$ and still more preferred from 20 to 50 ml/m$^2$ of developed material. When aluminum ions are present in the fixer solution in order to effect hardening, it is necessary to adjust the pH of the fixer in the range from 4.2 to 4.6 in order to get the highest hardening reactivity and to suppress swelling with washing water in the washing or rinsing step. For hardened materials having a swelling degree of the hydrophilic layers of less than 250% and more preferably of less than 200% it is not required for the fixer pH to held constant in the pH range from 4.2 to 4.6 as mentioned hereinbefore: in order to reduce irritating smell from sulphite ions in aqueous acidic medium which lead to sulphur dioxide vapour it is recommended to enhance pH to a value of 4.65 up to 5.00. A process whereby the quality of the fixer remains at an optimum level has been described in EP-A 0872 764.

Although it is possible to use whatever a processing unit adapted to the requirements described hereinbefore to reach the objectives concerning a perfect link between rapid processing and ecology, the objects of this invention concerning processing have e.g. been realized in the processing unit CURIX HT 530, trade name product marketed by Agfa-Gevaert.

New developments however become available with respect to processing apparatus. In a conventional processing apparatus the sheet material is transported along a generally horizontal feed path, the sheet material passing from one vessel to another usually via a circuitous feed path passing under the surface of each treatment liquid and over dividing walls between the vessels. However, processing machines having a substantially vertical orientation have also been proposed, in which a plurality of vessels are mounted one above the other, each vessel having an opening at the top acting as a sheet material inlet and an opening at the bottom acting as a sheet material outlet or vice versa. In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. The straight path is independent of the stiffness of the sheet material and reduces the risk of scratching compared with a horizontally oriented apparatus. In a vertically oriented apparatus, it is important to avoid, or at least minimize leakage of treatment liquid from one vessel to another and carry-over as the sheet material passes through the apparatus. Furthermore it is desirable that the treatment liquid in one vessel is not contaminated by contents of the adjacent vessels, that is neither by the treatment liquid of the next higher vessel nor by vapours escaping from the next lower vessel. In order to reduce consumption of treatment liquids, it is furthermore desirable to reduce the evaporation, oxidation and carbonization thereof. A solution therefore has been proposed in EP-A 0 744 656, wherein it has been disclosed that contamination and evaporation, oxidation and carbonization can both be reduced in a simple manner by a particular construction of the apparatus for the processing of photographic sheet material comprising a plurality of cells mounted one above the other in a stack to define a substantially vertical sheet material path through the apparatus, each cell comprising a housing within which is mounted a rotatable roller biased towards a reaction surface to define a roller nip there-between through which the sheet material path extends and associated sealing means serving to provide a gas-and liquid-tight seal between the roller and reaction surface on the one hand and a wall of the housing on the other. According to a first aspect, invention is characterized by means for connecting each cell to adjacent cells in the stack in a closed manner and according to a second aspect, the invention is characterized in that the roller is a drive roller.

Particularly the objectives set forth above may be achieved when the developing cell of the apparatus is a closed cell and the developing liquid contains an ascorbic acid developing agent as has been described in EP-Application No. 96201753, filed Jun. 24, 1996. According to that invention, there is provided a method of processing photographic sheet material by use of an apparatus comprising a plurality of processing cells so arranged to define a sheet material path through the apparatus, at least one of the cells constituting a developing cell containing a developing liquid, characterized in that the developing cell is a closed cell and the developing liquid contains an ascorbic acid developing agent.

With respect to further characteristics of the processing apparatus we refer to EP-A 0 819 992, wherein it was an object to provide an apparatus in which operating components can easily be replaced without the need for substantial re-programming of the CPU. This could be achieved when information concerning characteristics of each operating component is stored in separate memory means. A multi-component apparatus was thus provided comprising a plurality of operating components selected from output operating components, input operating components and combinations thereof, and a central processing unit operatively linked to said operating components, said central processing unit containing information concerning at least one desired operating sequence for said apparatus, characterized in that information concerning characteristics of each said operating component is stored in separate memory means. The programme which is typically carried in the CPU, is now seen as comprising two separable elements. Information concerning the desired function of the apparatus, i.e. logical data, such as the speed of sheet material through the apparatus, or the volume of liquid being pumped to vessels of the apparatus per unit time, continues to be stored in the CPU. Information concerning the characteristics of the operating components and their location, is separately stored for each operating component. The separate memory means is removable: when the service engineer removes a given operating component, he also removes the store of characteristics information pertaining to that operating component. As he replaces the removed operating component with a new one, he also provides a new information store, containing the characteristics information pertaining to the new operating component. The need for re-programming of the CPU is therefore avoided. The new information store is created off-site, for example as the new operating component is manufactured. In an alternative embodiment, the separate memory means is not removable, but is arranged to be by-passed or even re-programmed by the service engineer. Re-programming of the separate memory means is simpler than re-programming of the CPU. Improvements of that invention lie not only in the improved servicing characteristics but also in the quality assurance of replacement components. As a rule a processing apparatus for photographic sheet material comprises several treatment cells, most or all of which are in the form of vessels containing a treatment liquid, such as a developer, a fixer or a rinse liquid. As used herein, the term "sheet material" includes not only photographic material in the form of cut sheets, but also in the form of a web unwound from a roll. The sheet material to be processed is transported along a sheet material path through these vessels in turn, by transport means such as one or more pairs of path-defining drive rollers, and thereafter optionally to a drying unit. The time spent by the sheet material in each vessel is determined by the transport speed and the dimensions of the vessel is in the sheet feed path direction.

From time to time it is necessary to clean the processing apparatus, in order to remove debris which may derive from the sheet material itself and deposits derived from the treatment liquids. The usual process for cleaning a processing apparatus, whether of the vertical or horizontal configuration, is to drain the treatment liquids and to flush the apparatus through with cleaning liquid. Water, optionally containing various additives and optionally at an elevated temperature, is the usual cleaning liquid. Therefore it has ever been an object to provide an apparatus in which the path-defining rollers can be separated from each other in the open position, in a simple and convenient manner. The way in which this can be achieved has been described in WO 98/6005, wherein the path-defining rollers are supported by bearings carried by eccentric sleeves which are stationary in the closed position, and where means are provided for partly rotating the sleeves thereby to withdraw the path-defining rollers from each other into the open position.

A sheet material processing apparatus has thus been provided, comprising at least one treatment cell, a pair of rotatable path-defining rollers defining a sheet material path through the cell, the path-defining rollers having a closed position in which the path-defining rollers are biased into contact with each other to form a nip through which the sheet material path extends and an open position in which the path-defining rollers are spaced from each other, characterized in that the path-defining rollers are supported by bearings carried by eccentric sleeves which are stationary in the closed position, and means are provided for partly rotating the sleeves thereby to withdraw the path-defining rollers from each other into the open position.

It is clear that within the scope of the present invention any screen/film combination may be used, wherein said screen comprises at least luminescent monoclinic yttrium tantalate phosphors e.g. doped with niobium and gadolinium, optionally in combination with other suitable UV/blue light emitting phosphors and wherein said film comprises {111} tabular silver halide crystals rich in silver chloride spectrally sensitized with at least one or more azacyanine dyes in-combination with a processing unit, provided that with minimum amounts of silver coated (total amount, expressed as an equivalent amount of silver nitrate of less than 7.5 g /$m^2$ , particularly for double-side coated materials; and less than 3.75 g/$m^2$ for single-side coated materials) sufficient covering power is attained in the film in rapid ecological processing (with e.g. ascorbic acid and/or derivatives thereof as developing agent(s) in a hardener-free developer and an odor-free fixer, optionally free from aluminum ions, thereby reducing sludge; and replenishing amounts for developer and fixer as low as possible, i.e. from about 20 ml/$m^2$ up to at most 200 ml/$m^2$) and provided that an optimal relationship is attained between sensitometry and image quality, especially sharpness, thanks to low cross-over exposure, without residual color, thus providing a good image tone.

The following examples illustrate the present invention without however limiting it thereto.

EXAMPLES

Example 1

Exposure

Pairs of screens were arranged in the same type of cassette and between the screens and in contact therewith a duplitized (double-side silver halide emulsion coated) film was inserted. The X-ray exposure proceeded according to ISO/DP9236 with 77 median kVp X-rays.

As a pair of "comparative screens" (CS) the screens called "CX-BLUE-R4" or "BLUE M2" having M' Y(Sr,Li) $TaO_4$:Nb were used (tradename product from Agfa-Gevaert).

As a pair of "inventive screens" (IS) the screens called "MYTA:Gd:Nb" were used. The screens were prepared as described hereinafter.

The phosphor coating compositions were prepared by intimately mixing the following components:

| | |
|---|---|
| $YTaO_4$:Gd:Nb | 200 g |
| cellulose acetobutyrate (30% in 2-butanone) | 1.72 g |
| polyethyl acrylate (30% in ethyl acetate) | 15.46 g |
| ethyl acetate | 10.70 g |
| methyl glycol | 8.72 g |
| methoxypropanol | 26.7 g |
| dispersing agent DISPERSE AYD (trade name) | 1.02 g |

The compositions were doctor blade coated onto a subbed 200 μm thick pigmented polyethylene terephthalate supports.

By roll coater onto the dried phosphor-containing layer a cellulose acetobutyrate layer having a dry thickness of 10 μm was applied as protective layer. The total amount of phosphor coated was 50 mg/$cm^2$. The screen/film(s) combination(s) were used in a cassette, wherein the cassette was the same for each experimental film.

Films

Film materials comprising tabular {111} grains rich in silver bromide were the following.

Preparation of Silver Bromoiodide Tabular Grain Emulsion

The following Solutions were Prepared:

2,753 1 of a dispersion medium (C) containing 243 ml of potassium bromide, 0.1 M, and 5,5 g of inert gelatin were established at 51° C., pH=1.8, pBr=2.17;

a 1.96 molar silver nitrate solution (A);

a solution containing 1.96 moles/liter of potassium bromide (B);

Before starting pH was adjusted to a value of 2.5.

A nucleation step was performed by introducing solution A and solution B simultaneously in dispersion medium C both at a flow rate of 16 ml/min during 30 seconds. After a physical ripening time of 7 minutes, the temperature was raised to 70° C. in 25 minutes and after another 7 minutes pH was adjusted to a value of 5.0, making use from a solution of 2 molar of sodium hydroxide. After addition of 537 ml of a solution of gelatin (10 wt. %) and homogenizing the dispersing liquid in the reaction vessel during 5.5 minutes a first neutralization was performed by addition of solution B at a rate of 7.5 ml per minute for 148 seconds. A second neutralization step was performed by addition of solution A at a rate of 7.5 ml/minute during 60 seconds and of solution B at a rate in order to get a UAg value of 10 mV (mV versus sat. Ag/AgCl reference electrode). Grain growth was performed by addition at a linearly increasing velocity from 7.5 ml/min. up to 15 ml/min. of 502 ml of solution A in 2675 seconds, while adding solution B at a rate in order to get a constant UAg value of 10 mV. A third neutralization step was performed by addition of solution A at a constant rate of 7.5 ml per minute during 263 seconds. A fourth neutralization step was performed by addition of solution A at a rate of 7.5 ml/minute during 100 seconds and of solution B at a rate in order to get a UAg value of 60 mV. Grain growth was performed in a second growth step by addition at a linearly increasing velocity from 7.5 ml/min. up to 36.8 ml/min. of 930 ml of solution A in 2518 seconds, while adding solution B at a rate in order to get a constant UAg value of 60 mV. After 4 minutes 6.4 g of a 100% silver iodide Lippmann emulsion (containing 79 g, expressed as an equivalent amount of silver nitrate, per kg) were added and stirring continued for another 20 minutes.

After cooling to about 40° C. the addition of 56 ml of polystyrene sulphonic acid in 2 minutes was started, the pH value of the said dispersing medium was adjusted to a value of 3.5 with sulphuric acid and after cooling to 20° C. the obtained flocculate was decanted and washed three times with an amount of 4 1 of demineralized water (11° C.) in order to remove the soluble salts present. After decanting to a volume of 2 1 the washing procedure was repeated twice and after the last washing step, followed by sedimentation decantation was performed in order to have an emulsion volume as low as possible. An emulsion having {111} silver bromoiodide tabular grains having iodide present in an amount of 0.1 mole % was thus obtained. Peptization was further performed by addition of gelatin in order to get a gesi of 0.5 for an emulsion the concentration of which, expressed as an equivalent amount of silver nitrate, of 235 g/kg.

The said silver bromoiodide tabular emulsion showed the following grain characteristics:

an average equivalent volume diameter E.V.D. of 0.72 μm;

an average thickness t of 0.15 μm;

an average aspect ratio AR of 9.0.

a numerical percentage of tabular hexagons of more than 95%.

Data for aspect ratio AR and thickness t, as well as procentual amount of hexagons, were obtained from electron microscopic photographs: the diameter of the grain was defined as the diameter of the circle having an area equal to the projected area of the grain as viewed in the said photographs.

Data for E.V.D. were obtained after computing signals obtained from reduction of individual grains and representative for the volume of each grain before reduction.

Before the start of the chemical ripening the UAg-value of the emulsion was adjusted at +100 mV (against a silver/silver chloride reference electrode) and the pH-value at 6.0 with sodium hydroxide. Chemical ripening agents were adapted to the crystal size of the emulsions: amounts are given in the Table 1 hereinafter.

Chemical ripening agents were gold thiocyanate, sodium thiosulphate as a source of sulphur, N-(carboxyethyl)-2-seleno-benzothiazole (see formula VI hereinafter) as a source of selenium and toluene thiosulphonic acid (see formula VII) was used as predigestion agent. As stabilizing agent in the chemical ripening p-carboxy-phenyl-mercaptotetrazole (see formula VIII) was added. The amounts of each chemical ripening agent (given in Table 1 per 500 ml of an equivalent amount of silver nitrate present in the emulsion) were optimized in order to obtain an optimal fog-sensitivity relationship after 2 hours at 54° C.

(VI)

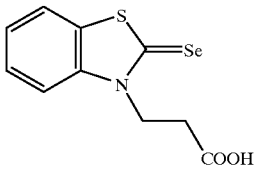

-continued (VII)

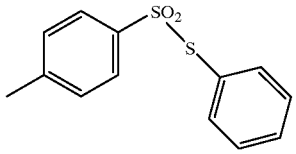

(VIII)

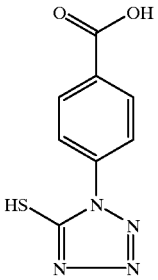

5 minutes predigestion time was taken after addition of the toluene thiosulphonic acid predigestion solution ($1.29\times10^{-6}$ mole per mole of silver) before dyes, the formulae of which are given hereinafter, were added:

(I.1.1)

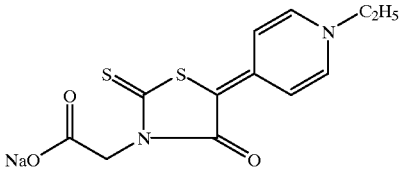

Dye B (II.2.1)

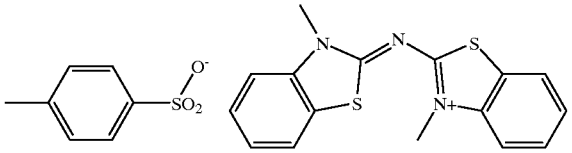

Dye A

Dye B was added as a solution containing 4 g per liter in demineralized water.

Dye A was added as a solution containing 10 g per liter in methanol.

After addition of the said dyes, a digestion time of 30 minutes was respected before addition of a KSCN solution (10 wt. % in demineralized water) in an amount of $8.75\times10^{-4}$ mole per mole of silver. After said addition another time of 5 minutes was waited before addition of the compounds providing sulphur ($Na_2S_2O_3$.5aq.: $8.59\times10^{-6}$ mole per mole of silver), selenium (compound VI: $4.39\times10^{-6}$ mole per mole of silver) and gold ($HAuCl_4.4H_2O$::$3.22\times10^{-6}$ mole per mole of silver). Stabilizing compound VIII was added as last solution in an amount of $1.28\times10^{-4}$ mole per mole of silver. All amounts given in the Table 1 are given in ml of the added solutions.

TABLE 1

| Compound\EM | 1 | 2 | 3 |
|---|---|---|---|
| VI | 3.7 | = | = |
| VII | 0.8 | = | = |
| Dye B | 350 | | 263 |
| Dye A | | 236 | 59 |
| KSCN | 2.5 | = | = |
| $Na_2S_2O_3.5aq$ | 4 | = | = |
| $HAuCl_4.4H_2O$ | 6.5 | = | = |
| VIII | 10 | = | = |

=indicates that the same amounts are used for each emulsion;

highest amounts of dyes are corresponding with a surface grain coverage of 100% and are corresponding with following amounts expressed as moles of dye added per mole of silver:

dye B: $1.49\times10^{-3}$ dye A: $1.66\times10^{-3}$

Preparation of the Film Material

After addition of the normal coating additives to each emulsion the solutions were coated simultaneously together with a protective layer containing 1.3 g gelatine per $m^2$ per side on both sides of a polyethylene terephthalate film support having a thickness of 175 $\mu$m. Materials were numbered in the Table 2 hereinafter in the same way as the emulsions in the Table 1 above.

The resulting photographic material contained per side an amount of silver halide corresponding to 3.5 grams of $AgNO_3$ per $m^2$ and an amount of gelatin corresponding to 2.8 g/$m^2$.

The processing was run in the developer G138®, followed by fixing in fixer G335® and rinsing at the indicated temperature of 35° C. for a total processing time of 45 seconds.

Sensitometric data are expressed for

"fog" levels F, calculated as difference of the measured density in the minimum density range and density of the film support: figures obtained are calculated with a factor of 1000;

"maximum density" $D_{max}$, calculated as difference between measured density in the maximum density range and minimum density in the minimum density range::figures obtained are calculated with a factor of 100;

speed values $S_{0.2}$ and $S_{1.0}$, determined at a density of 0.2 and 1.0 above minimum density, wherein said values (logarithmic values) are multiplied by a factor of 100: a decrease with 30 units is indicative for a doubling in speed;

gradation levels G, are determined between a density of 0.2 and 1.0 above minimum density::figures obtained are calculated with a factor of 100.

In Table 2 results are summarized for the different film materials after exposure and processing as set forth above.

TABLE 2

| MATL. | 1(c) | 2(c) | 3 |
|---|---|---|---|
| F | 3 | 1 | 4 |
| $D_{max}$ | 397 | 400 | 400 |
| $S_{0.2}$ | 162 | 174 | 121* |
| $S_{1.0}$ | 189 | 208 | 153* |
| G | 296 | 234 | 243 |

Material No. 1 is the comparative material. Figures having a '*' are indicating best results obtained.

As becomes clear from the data given in Table 2 it is possible to reach the required and even improved speed when use is made of a film/screen combination wherein the film material is coated from a {111} tabular grain emulsion rich in silver bromide and wherein the said grains have been spectrally sensitized with a combination of dyes as given hereinbefore, wherein the combination of dye B with dye A (see Material No. 3) is providing the highest speed with an acceptable gradation and wherein the presence of dye A permits dye B to be coated in a lower amount (−25%). No dye stain was disturbing the outlook of the tested film materials.

Example 2

The same emulsion as in Example 1 was chemically ripened in the following way.

Chemical ripening agents were gold thiocyanate, sodium thiosulphate as a source of sulphur, N-(carboxyethyl)-2-seleno-benzothiazole (see formula VI hereinbefore) as a source of selenium and toluene thiosulphonic acid (see formula VII hereinbefore) was used as predigestion agent. As stabilizing agent in the chemical ripening p-carboxyphenyl-mercaptotetrazole (see formula VIII in Example 1) was added. The amounts of each chemical ripening agent (given in Table 1 per 500 ml of an equivalent amount of silver nitrate present in the emulsion) were optimized in order to obtain an optimal fog-sensitivity relationship after 2 hours at 54° C. A predigestion time of 5 minutes was taken after addition of the toluene thiosulphonic acid predigestion solution ($1.29\times10^{-6}$ mole per mole of silver) before dyes B and A , the formulae of which have been given hereinbefore in Example 1, were added:

Dye B was added as a solution containing 4 g per liter in demineralized water.

Dye A was added as a solution containing 10 g per liter in methanol.

After addition of the said dyes, a digestion time of 30 minutes was respected before addition of a KSCN solution (10 wt. % in demineralized water) in an amount of $8.75\times10^{-4}$ mole per mole of silver. After said addition another time of 5 minutes was waited before addition of the compounds providing sulphur ($Na_2S_2O_3.5aq.$: $8.59\times10^{-6}$ mole per mole of silver), selenium (compound VI: $4.39\times10^{-6}$ mole per mole of silver) and gold ($HAuCl_4.4H_2O$::$3.22\times10^{-6}$ mole per mole of silver).

All amounts given in the Table 3 are given in ml of the added solutions.

TABLE 3

| Compound\EM | 4 | 5 | 6 |
|---|---|---|---|
| VI | 10 | 5 | 5 |
| Dye B | 200 | = | = |
| Dye A | 0 | 20 | 35 |
| $Na_2S_2O_3.5aq$ | 8 | = | = |

The preparation of the film material, the exposure and the processing thereof were run in the same conditions as in Example 1.

Sensitometric data are expressed for

"fog" levels FD, calculated as total density measured in the minimum density range: figures obtained are calculated with a factor of 1000, inclusive for the density of the support;

speed value $S_{0.2}$ determined at a density of 0.2 above minimum density, wherein said value (logarithmic value) has been multiplied by a factor of 100: a decrease with 30 units is indicative for a doubling in speed;

darkroom light sensitivity: density difference (expressed in measured density×1000) between exposed and unexposed part of the film, the exposed part being exposed to darkroom light during 3 minutes with a darkroom filter GBX3, so that the light intensity at the film is 36 lux.

In Table 4 results are summarized for the different film materials coated from materials having emulsions, chemically ripened in a different way as set forth above.

TABLE 4

| MATL. | 4 | 5 | 6 |
|---|---|---|---|
| FD | 220 | 207 | 207 |
| $S_{0.2}$ | 181 | 176 | 170 |
| G | 234 | 243 | 264 |
| DRS | 283 | 63 | 0 |

Addition in an increasing amount of dye A (azacyanine dye) to the emulsions besides dye B (blue sensitizer) makes decrease fog and increase speed (sensitivity), even though amounts of compound (VI) have remarkably been reduced. This is indicative for the more "site-directed" or "epitiaxial" chemical ripening which is expected to be more efficient. The favorable results obtained are moreover accompanied by a decrease of darkroom sensitivity, which again offers advantages for practicians.

Having described in detail preferred embodiments of the present invention it is understood by a person skilled in the art that, within the scope of the present invention, it is not limited thereto.

What is claimed is:

1. A film material having at least one emulsion comprising {111} tabular silver halide grains rich in silver bromide, spectrally sensitive to irradiation in a wavelength range shorter than 420 nm by a presence of at least one spectral sensitizer according to formula (I) and of at least one azacyanine dye, wherein in formula (I)

(I)

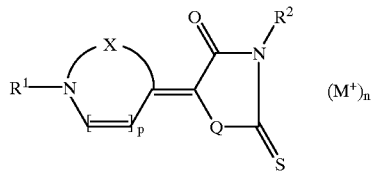

X represents atoms necessary to form a heterocyclic 5- or 6-membered ring, whether or not conjugated with a benzene ring;

Q represents S, $NR^3$, O, or —(C=O)—N($R^4$)—;

$M^+$ represents a cation, e g., $Li^+$, $Na^+$, $K^+$, $HN^+(C_2H_5)_3$;

n equals 0, 1, or 2;

p equals 0 or 1;

$R^1$, $R^2$, $R^3$ and $R^4$ each independently represents a $C_1$–$C_5$ alkyl chain, or a (five- or six-membered) aromatic ring, provided that at least one of $R^2$, $R^3$ and $R^4$ has a solubilizing group or a latent solubilizing group.

2. A film material according to claim 1, wherein said spectral sensitizer corresponds to formula (I.1) or (I.2)

(I.1)

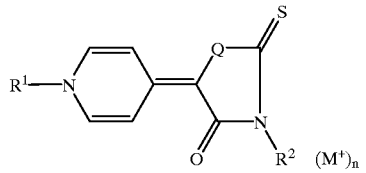

(I.2)

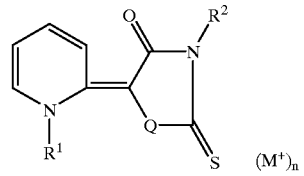

3. A film material according to claim 1, wherein said azacyanine dye corresponds to formula (II.1) or (II.2)

(II.1)

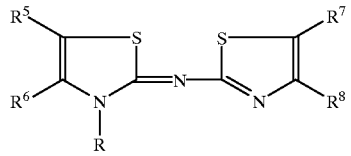

(II.2)

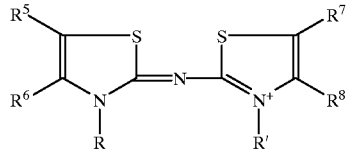

wherein each substituent $R^5$–$R^8$ independently represents hydrogen, an alkyl, an aryl or an aralkyl;

wherein $R^5$ and $R^6$ and/or $R^7$ and $R^8$ may form a benzoring, which, if substituted, has same or different substituent(s) as $R^5$–$R^8$;

wherein R represents an alkyl, an aryl or an aralkyl group; wherein R' represents hydrogen, an alkyl, an aryl or an aralkyl group;

and wherein cations or anions are present as charge compensating ions.

4. A film material according to claim 1, wherein said {111} tabular silver halide grains rich in silver bromide have an average aspect ratio of 5 or more, an average grain thickness of at most 0.25 $\mu$m, and account for at least 50% of a total projective area of all grains.

5. A film material according to claim 1, wherein said {111} tabular silver halide grains rich in silver bromide have an average aspect ratio of from 5 up to 20, an average grain thickness of from 0.06 $\mu$m to 0.22 $\mu$m, and account for at least 70% of a total projective area of all grains.

6. A film material according to claim 1, wherein said {111} tabular silver halide grains rich in silver bromide are chemically sensitized with compounds providing sulphur, selenium and gold.

7. A radiographic screen/film combination comprising a duplitized film material sandwiched between a pair of supported or self-supporting X-ray intensifying screens, wherein i) said pair of supported or self-supporting X-ray intensifying screens essentially consists of luminescent phosphor particles emitting at least 50% of their emitted radiation in a wavelength range shorter than 420 nm, ii) said film material is a material according to claim 1, wherein said emulsion is present in at least one light-sensitive emulsion layer at both sides of a film support.

8. A radiographic screen/film combination comprising a duplitized film material sandwiched between a pair of supported or self-supporting X-ray intensifying screens, wherein i) said pair of supported or self-supporting X-ray intensifying screens essentially consists of luminescent phosphor particles emitting at least 80% of their emitted radiation in a wavelength range shorter than 420 nm, ii) said film material is a material according to claim 1, wherein said emulsion is present in at least one light-sensitive emulsion layer at both sides of a film support.

9. A radiographic screen/film combination according to claim 7, wherein said phosphor particles are niobium and gadolinium doped, monoclinic M, yttriumtantalate (MYT) phosphor corresponding to formula (IV):

$$YTaO_4:Gd:Nb \qquad \text{(IV)}.$$

10. A radiographic screen/film combination according to claim 8, wherein said phosphor particles are niobium and gadolinium doped, monoclinic M, yttriumtantalate (MYT) phosphor corresponding to formula (IV):

$$YTaO_4:Gd:Nb \qquad \text{(IV)}.$$

11. A method of image forming comprising exposing to X-rays a radiographic screen/film combination according to claim 9, consecutively followed by processing the screen/film combination in a processor by steps of developing, fixing, rinsing and drying.

12. A method of image forming comprising exposing to X-rays a radiographic screen/film combination according to claim 10, consecutively followed by processing the screen/film combination in a processor by steps of developing, fixing, rinsing and drying.

* * * * *